US010271691B1

(12) United States Patent
Boyle

(10) Patent No.: US 10,271,691 B1
(45) Date of Patent: Apr. 30, 2019

(54) PORTABLE SELF-CONTAINED HOT WATER HAND-WASHING STATION

(71) Applicant: James Boyle, Mesa, AZ (US)

(72) Inventor: James Boyle, Mesa, AZ (US)

( * ) Notice: Subject to any disclaimer, the term of this patent is extended or adjusted under 35 U.S.C. 154(b) by 0 days.

(21) Appl. No.: 15/862,504

(22) Filed: Jan. 4, 2018

(51) Int. Cl.
*A47K 1/00* (2006.01)
*A47K 1/02* (2006.01)
*A47K 1/05* (2006.01)

(52) U.S. Cl.
CPC . *A47K 1/02* (2013.01); *A47K 1/05* (2013.01)

(58) Field of Classification Search
CPC ..... A47K 1/02
USPC ... 4/625, 619–620, 624, 626, 628, 639–640, 4/643–644, 646, 650, 653
See application file for complete search history.

(56) References Cited

U.S. PATENT DOCUMENTS 3,192,537 A * 7/1965 Coffman ..... A45D 19/04 4/516
3,594,830 A * 7/1971 Clifton ..... A45D 19/04 4/625
4,081,867 A * 4/1978 Simeola ..... A45D 19/04 4/516
4,130,123 A * 12/1978 Wines, Jr. ..... A47K 1/02 134/152
4,660,233 A * 4/1987 Beaver ..... A61G 7/0005 4/516
4,998,302 A * 3/1991 Silva ..... A45D 19/04 4/516
5,182,822 A * 2/1993 Cyr ..... A47K 1/02 4/625
5,465,438 A * 11/1995 Allman ..... A47K 1/02 4/516
5,548,856 A * 8/1996 Julian ..... B60R 15/04 4/625
5,687,434 A * 11/1997 Tagg ..... A47K 1/02 4/625
5,702,115 A * 12/1997 Pool ..... A61G 12/001 280/47.35
5,926,866 A * 7/1999 Chao ..... A47K 3/024 4/572.1
6,173,458 B1 * 1/2001 Maddux ..... A47K 1/02 4/619
6,256,803 B1 * 7/2001 Sauerbrei ..... A47D 5/003 4/443
6,401,274 B1 * 6/2002 Brown ..... A47K 1/02 4/619

(Continued)

*Primary Examiner* — Lori Baker

(57) ABSTRACT

A portable hand-washing station that is self-contained to provide hot and cold water to a user as well as dispose of said water. The station includes a rolling hand truck, a sink assembly, a fresh-water tank, a grey-water tank, a water heater, and a water pump. The rolling hand truck includes a base platform and a vertical frame for support. The sink assembly is perpendicularly mounted to the vertical frame, opposite to the base frame. The grey-water tank and the fresh-water tank are positioned in between the sink assembly and the base platform and each are adjacently attached to the rolling hand truck. The grey-water tank and the fresh-water tank are in fluid communication with the sink assembly through the water pump and the water heater to provide the user with clean water. Additionally, a drain of the sink assembly is in fluid communication with the grey-water tank for disposal.

9 Claims, 6 Drawing Sheets

(56) References Cited

U.S. PATENT DOCUMENTS

D463,646 S * 9/2002 Pai ..... A47K 1/02 D34/19
D468,881 S * 1/2003 Cox ..... A47K 1/02 D34/19
6,637,049 B2 * 10/2003 Gallant ..... A61G 7/00 312/249.7
6,711,757 B2 * 3/2004 Peck ..... A47K 1/02 4/516
D489,155 S * 4/2004 Underbrink ..... A47K 1/02 D23/286
6,976,279 B1 * 12/2005 Berke ..... A61H 35/02 239/146
7,240,379 B2 * 7/2007 Switzer ..... A47F 9/00 4/625
7,441,286 B1 * 10/2008 Taylor Parker ..... A47K 1/02 280/652
7,730,561 B2 * 6/2010 Kostelyk ..... A47K 1/02 4/625
D624,633 S * 9/2010 Watts ..... A47K 1/02 D23/286
8,082,611 B1 * 12/2011 Marshall ..... A47K 1/02 239/146
D655,507 S * 3/2012 Alcorn ..... A47K 1/02 D3/312
8,245,330 B2 * 8/2012 Atkinson ..... E03B 1/04 4/625
8,528,126 B2 * 9/2013 Al-Mahnna ..... A47K 1/02 4/626
8,602,353 B2 * 12/2013 Lindauer ..... B64D 11/02 244/118.5
8,966,677 B1 * 3/2015 Leihgeber ..... A47K 3/024 4/572.1
2007/0199146 A1 * 8/2007 Kostelyk ..... A47K 1/02 4/625
2009/0301523 A1 * 12/2009 Barnhill ..... G16H 40/20 134/18

* cited by examiner

PORTABLE SELF-CONTAINED HOT WATER HAND-WASHING STATION

FIELD OF THE INVENTION

The present invention relates generally to cleaning facilities and systems. More specifically, the present invention is a portable hand-washing station, a portable sink essentially. The present is a self-container portable sink that does not require any external resources for functionality.

BACKGROUND OF THE INVENTION

Human hygiene is the practice and environmental conditions conductive to health and prevention of the spreading of germs, and thus diseases. The easiest and most effective way to stay hygienic is to clean and wash one's body. It is especially important to clean one's hands and face as the hands as they are constantly exposed to direct contact with external surfaces. Washing the outer surfaces of one's body on a frequent basis protects human's health and promotes a clean environment to those around the person. One of the main modern sanitation systems is a sink, also known as a washbowl or a hand basin. A sink is an open vessel design to hold or receive water in which one can wash various body parts such as the hands and feet. Traditional sinks are permanent installations with their own plumbing and piping. This is a quite limiting factor as there are mobile situations and environments do not have access to a means of cleaning oneself. Such situations include festivals, outdoor concerts, construction sites, and military sites to name a few non-limiting examples. Hygiene is extremely important in such situations as the congregation of humans yield a high amount of contact between the people and surfaces and this results in germs and bacteria being spread at a high rate. The present invention provides a means for washing oneself anywhere and anywhere. More specifically, the present invention is a mobile sink. The present invention is a self-contained and a self-powered sink that can be easily transported anywhere with ease.

DETAIL DESCRIPTIONS OF THE INVENTION

All illustrations of the drawings are for the purpose of describing selected versions of the present invention and are not intended to limit the scope of the present invention.

The present invention generally relates to cleaning facilities. More specifically, the present invention is a portable sink that is self-contained and requires no external resources. The present invention includes a fresh-water supply, an electric power source, a tank for grey-water, and a heater. Additionally, the present invention is easily portable such that the present invention may be transported to and within a construction site, a public protest, a festival, military sites, and other similar environments.

Figure 1:
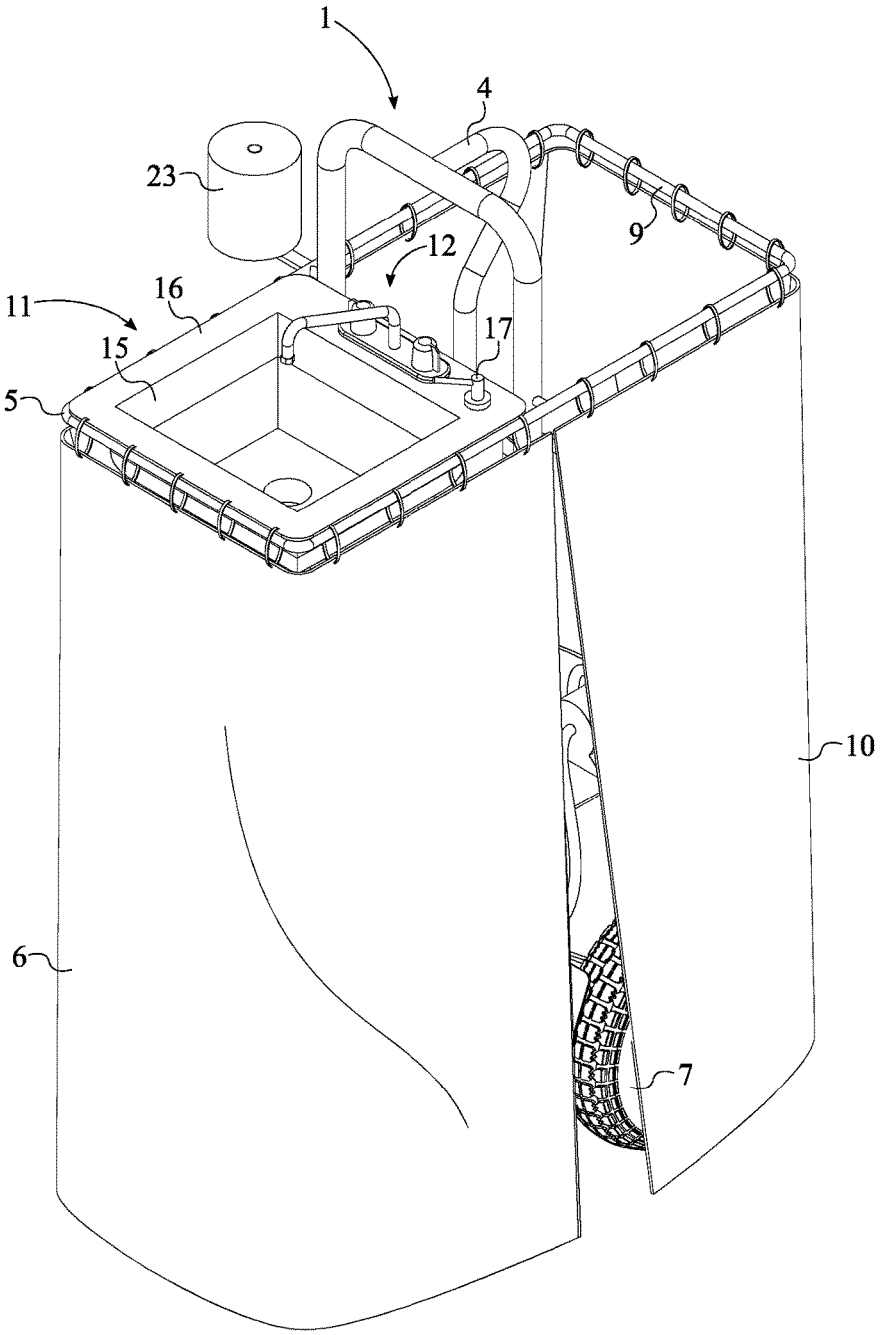
FIG. 1 is a perspective view of the present invention.
Figure 2:
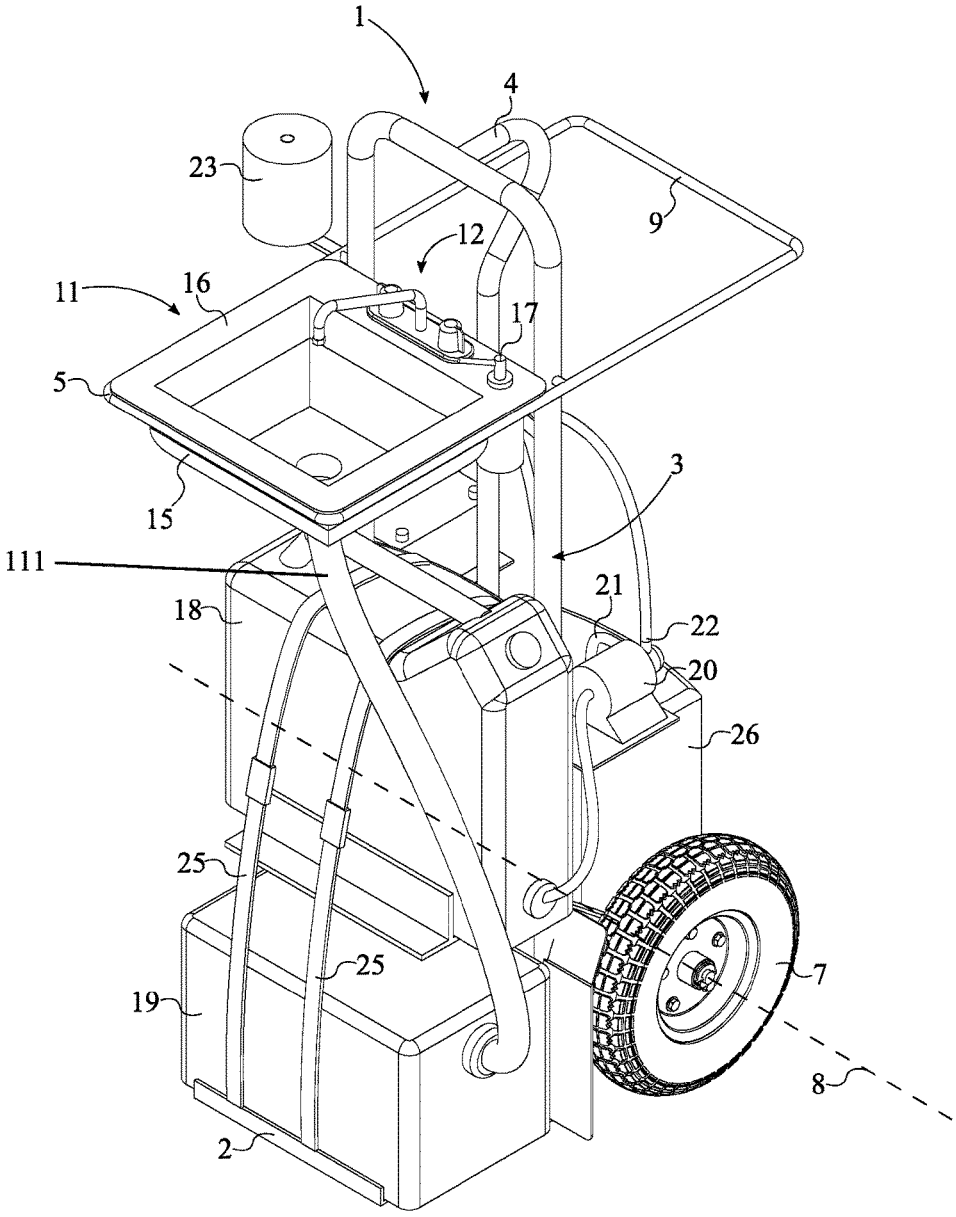
FIG. 2 is a perspective view of the present invention with the first curtain and the second curtain omitted.

Referring to FIG. 1 and FIG. 2, in its simplest embodiment, the present invention comprises a rolling hand truck 1, a sink assembly 11, a fresh-water tank 18, a grey-water tank 19, a water heater 26, and a water pump 20. The rolling hand truck 1 houses and supports the present invention. Additionally, the rolling hand truck 1 allows the whole present invention to be easily portable. A variety of designs may be used for the rolling hand truck 1 but the preferred rolling hand truck 1 comprises a base platform 2, a vertical frame 3, a handle 4, and a pair of primary wheels 7. The base platform 2 is a shelf-like device used to hold and support the grey-water tank 19. The base platform 2 is a rectangular shaped plate that is terminally and perpendicularly connected to the vertical frame 3. The vertical frame 3 is an elongated support structure which raises and supports the subcomponents of the present invention. It is preferred that the vertical frame 3 is a set of vertical poles that are rigidly connected to each other, similar to traditional truck dollies designs. The handle 4 acts as a grasping element for the user, providing the user with the ability to easily tilt and transport the invention. The handle 4 is a set of ergonomic rods attached to the vertical frame 3. In particular, the handle 4 is terminally connected to the vertical frame 3, opposite the base platform 2, for additional leverage and ease of use. The pair of primary wheels 7 allow the present invention to be easily rolled. It is preferred that each of the pair of primary wheels 7 is a pneumatic wheel sized to support the overall weight of the present invention. Similar to traditional designs, the pair of primary wheels 7 is coaxially positioned with each other, across the base platform 2 with a primary axis 8 of the pair of primary wheels 7 being positioned offset to the vertical frame 3. Additionally, each of the pair of primary wheels 7 is rotatably mounted to the vertical frame 3, adjacent to the base platform 2.

Figure 4:
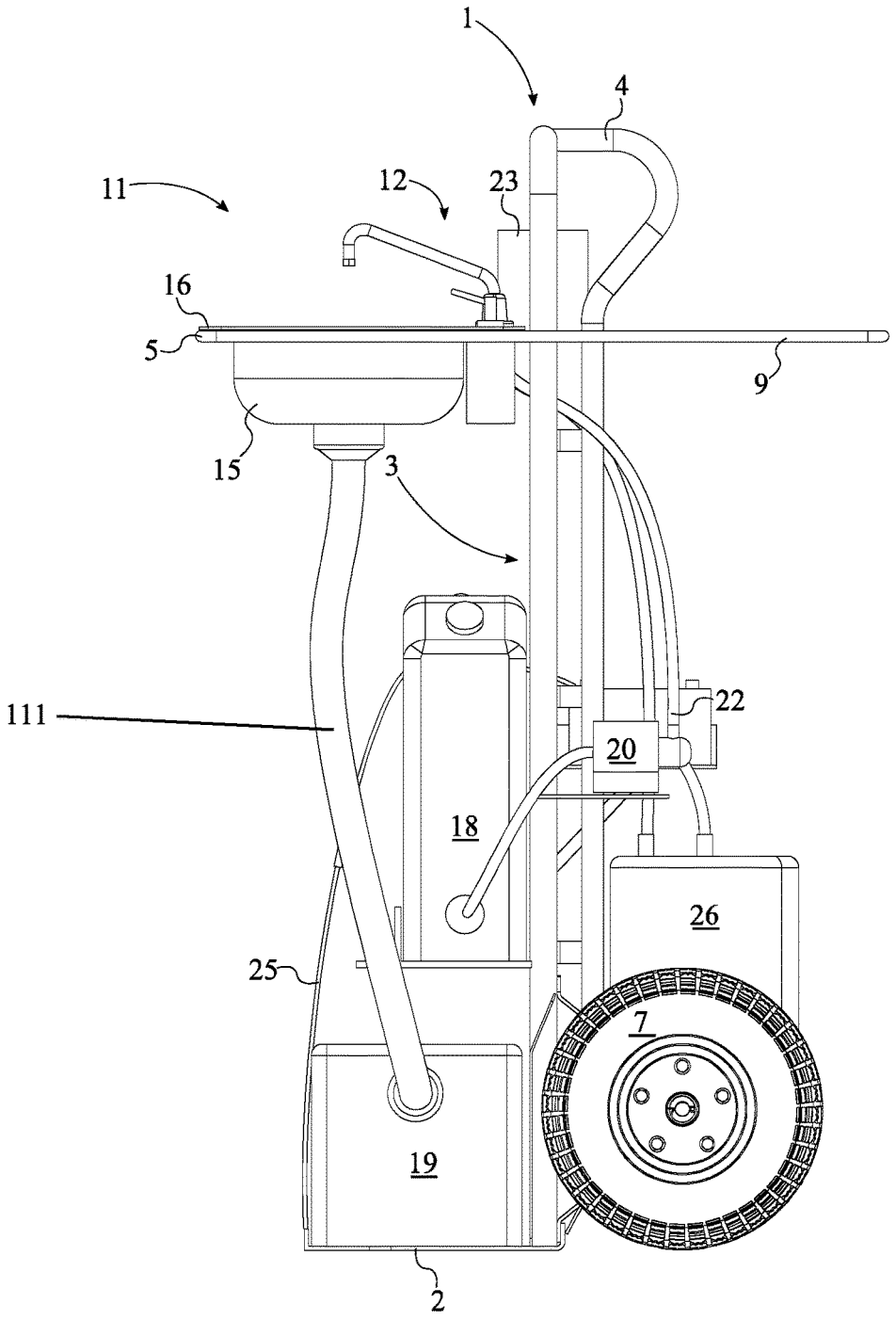
FIG. 4 is a side-view of the present invention with the first curtain and the second curtain omitted.

The sink assembly 11 is a plumbing fixture which allows the user to wash his or her hands, face, or dishes to name a few non-limited examples. Referring to FIG. 4, the sink assembly 11 is positioned opposite to the base platform 2, along the vertical frame 3. Additionally, the sink assembly 11 is perpendicularly mounted to the vertical frame 3. Preferably, the sink assembly 11 is mounted at a hip level relative to the base platform 2 being on the ground, in particularly 42 inches from the base platform 2. The fresh-water tank 18 is a container which holds clean water for the use of the sink assembly 11. The grey-water tank 19 is a container which receives and stores the runoff, dirty or also known as grey-water, from the sink assembly 11. The grey-water tank 19 and the fresh-water tank 18 are positioned in between the sink assembly 11 and the base platform 2. Additionally, the grey-water tank 19 and the fresh-water tank 18 are adjacently attached to the rolling hand truck 1. Resultantly, the present invention includes a water supply and water runoff storage means, yielding a closed system not requiring any external resources. The water heater 26 receives water from the fresh-water tank 18 and heats up said water. The water heater 26 is mounted to the vertical frame 3, opposite the sink assembly 11 in order to balance out the present invention. In one embodiment, the water heater 26 is an electric water heater 26. In another embodiment, the water heater 26 is a propane water heater 26. The water pump 20 is a mechanical device which moves water from the fresh-water tank 18 to the appropriate components of the present invention. The water pump 20 is mounted to the vertical frame 3, adjacent to the water heater 26.

Figure 6:
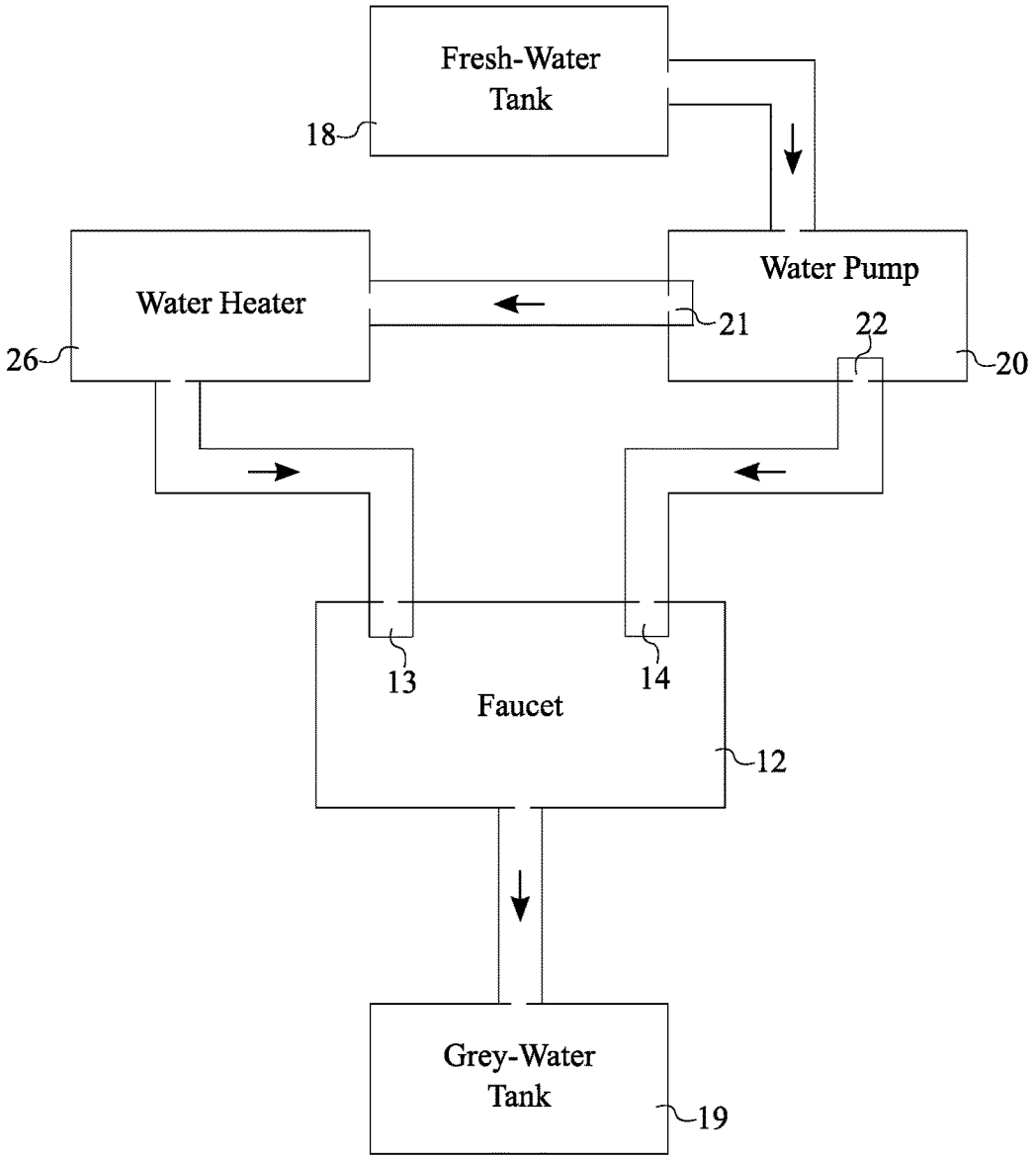
FIG. 6 is a fluid communication schematic of the present invention.

Referring to FIG. 6, the water system of the present invention is one of the unique aspects because it is a closed system, thus allowing the present invention to be highly portable and versatile. More specifically, clean water is stored and dispersed from the fresh-water tank 18. In particular, the clean water is dispersed by the water pump 20. For this, the fresh-water tank 18 is in fluid communication with the water pump 20. Overall, the water pump 20 supplies water to the faucet 12 for use. This is accomplished directly for cold water and indirectly for warm water. For the cold water, a cold-water outlet 22 of the water pump 20 is in fluid communication with a faucet 12 of the sink assembly 11. For the warm water, the clean water is first pumped to the water heater 26. More specifically, a hot-water outlet 21 of the water pump 20 is in fluid communication with the water heater 26 and the water heater 26 is in turn in is fluid communication with the faucet 12. Upon receiving clean water from the water pump 20, the water heater 26 applies heat to the clean water in order to raise the overall temperature of the clean water, yielding warm or hot water. The water heater 26 then acts as a hot water reservoir to the faucet 12. Upon use, the water from the faucet 12 may or may not be contaminated/dirty, also known as grey water. Grey water is gently used water and may contain traces of dirt, food, grease, soap, detergent, household cleaning products, and other similar agents. The grey water is dispersed from the sink assembly 11 through a drain 111. Finally, the grey water is stored by the grey-water tank 19 until proper disposal or water treatment. For this, the drain 111 of the sink assembly 11 is fluid communication with the grey-water tank 19.

Each of the fluid connections referenced and described within the present invention may be accomplished through a variety of traditional plumbing means. Type of plumbing that may be used for the present invention includes, but is not limited to, PVC pipes, threaded pipes, valves, galvanized pipes, and other similar plumbing fixtures. In the preferred embodiment, the present invention utilizes threaded piping for the fluid connections as threaded piping is highly flexible, ideal for portable plumbing systems.

The sink assembly 11 may be mounted to the vertical frame 3 through a variety of means. In the preferred embodiment of the present invention, the rolling hand truck 1 further comprises a first U-shaped frame 5. The first U-shaped frame 5 receives and supports the sink assembly 11. The first U-shaped frame 5 is an elongated rod-like structure that is bent 90 degrees at two spots to yield a U-shape. The first U-shaped frame 5 is positioned in between the handle 4 and the base platform 2. Additionally, the first U-shaped frame 5 is perpendicularly and laterally connected to the vertical frame 3. The first U-shaped frame 5 is preferably composed of a strong metal and is sized to the outer dimensions of the sink assembly 11. Referring to FIG. 2, the sink assembly 11 is positioned within the first U-shaped frame 5 and is perimetrically mounted to the first U-shaped frame 5. In an alternative embodiment of the present invention, the sink assembly 11 is integrated directly into the vertical frame 3.

A variety of designs and shapes may be used for the sink assembly 11, but in the preferred embodiment of the present invention, the sink assembly 11 comprises a faucet 12, a sink body 15, a mounting lip 16, and a soap dispenser 17. The sink body 15 is a hollow body which receives the water dispensed by the faucet 12. The size, design, shape, and material composition of the sink body 15 is subject to change in order to meet the needs and preferences of user. The mounting lip 16 is a plate which mounts the sink body 15, and therefore the sink assembly 11, to the first U-shaped frame 5. In particular, the mounting lip 16 is laterally connected about the sink body 15. The sink body 15 is positioned within the first U-shaped frame 5 and is held in place by the mounting lip 16; wherein the mounting lip 16 is pressing against the first U-shaped frame 5. The faucet 12 is a valve device which controls the flow of water. Different designs may be utilized for the present invention including, but not limited to, ball faucets, disk faucets, cartridge faucets, compression faucets, and other similar devices. The faucet 12 comprises a hot-water inlet 13 and a cold-water inlet 14. The hot-water inlet 13 and the cold-water inlet 14 are each an inlet pipe. The faucet 12 is integrated into the mounting lip 16, adjacent to the vertical frame 3, similar to traditional designs. Additionally, the hot-water inlet 13 and the cold-water inlet 14 are each oriented towards the base platform 2, essentially underneath the sink body 15 and hidden from the user's view. The hot-water inlet 13 receives the hot water from the water heater 26 while the cold-water inlet 14 receives the cold water from the fresh-water tank 18 through the water pump 20. More specifically, the hot-water inlet 13 is in fluid communication with the water heater 26. Similarly, the cold-water inlet 14 is in fluid communication with the cold-water outlet 22 of the water pump 20. The soap dispenser 17 stores and distributes a detergent for the user. The soap dispenser 17 is positioned adjacent to the faucet 12 and is perpendicularly integrated into the mounting lip 16.

Figure 3:
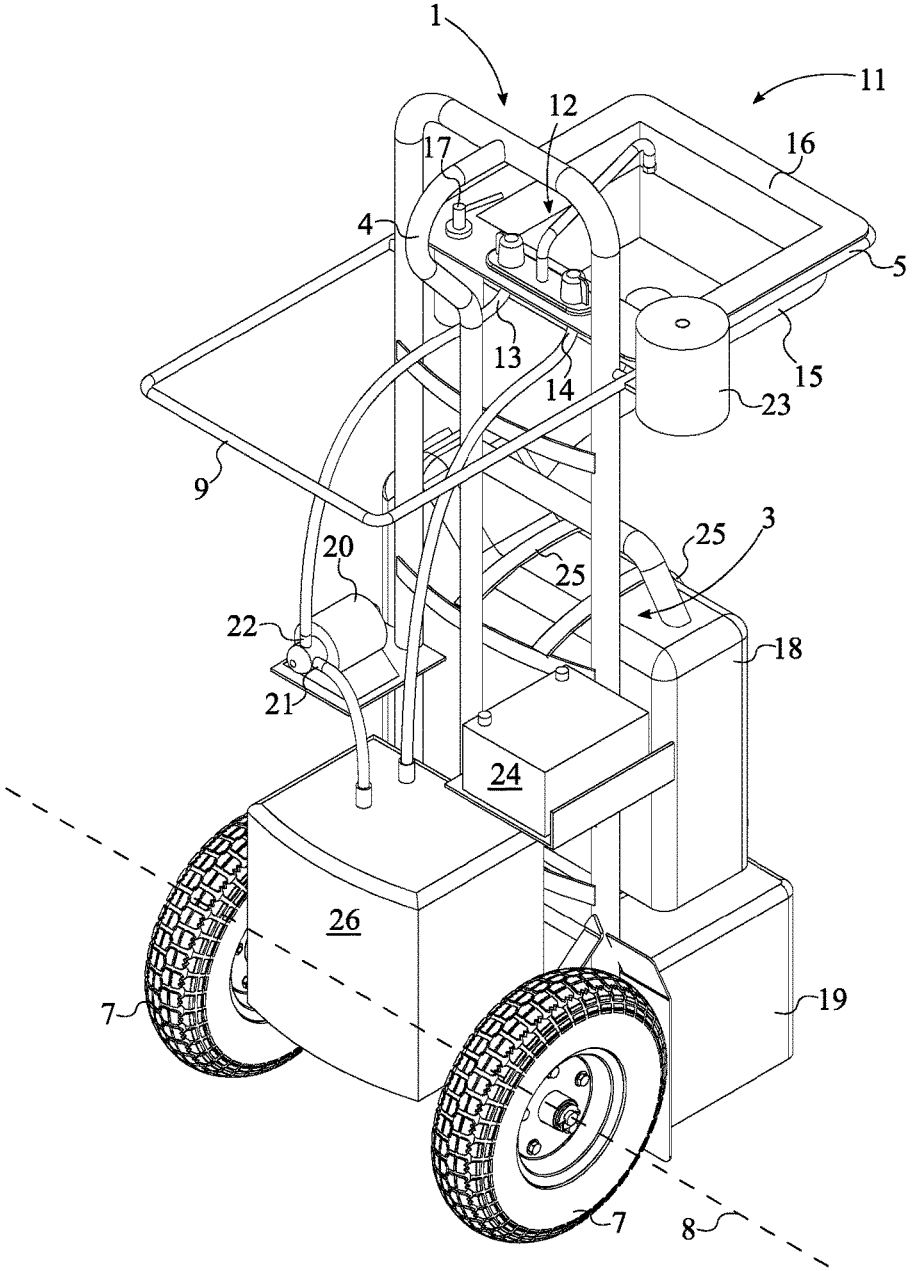
FIG. 3 is a rear perspective view of the present invention with the first curtain and the second curtain omitted.

Referring to FIG. 3, the present invention may also comprise a paper towel holder 23. The paper towel holder 23 is an elongated rod which receives and holds a towel roll. The towel roll provides the user with a means drying himself or herself. In relation to the rolling hand truck 1, the paper towel is positioned parallel and offset to the vertical frame 3. Additionally, the paper towel is positioned adjacent to the sink assembly 11 for a closer proximity to the user. Furthermore, the paper towel is laterally connected to the vertical frame 3. In the preferred embodiment, the paper towel includes a retaining mechanism which holds the towel roll and prevents said towel roll from unrolling and waving in the wind.

In the preferred embodiment, the grey-water tank 19 is a seven-gallon tank and the fresh-water tank 18 is a five-gallon tank. Additionally, the grey-water tank 19 is positioned adjacent to the base platform 2 while the fresh-water tank 18 is positioned adjacent to the grey-water tank 19, opposite the base platform 2. Furthermore, for disposal and refill purposes the grey-water tank 19 and the fresh-water tank 18 are attached to the rolling hand truck 1 by an at least one adjustable strap 25. This allows the user to easily remove the fresh-water tank 18 and the grey-water tank 19 from the rolling hand truck 1 by simply untethering the adjustable strap 25. Resultantly, refilling the fresh-water tank 18 and emptying the grey-water tank 19 can be accomplished quickly and efficiently without requiring the user transporting the whole present invention. For maximum stability, the at least one adjustable strap 25 comprises a first strap and a second strap as seen in FIG. 2. The first strap and the second strap attach to the base platform 2, traverse through the handle of the grey-water tank 19 and the fresh-water tank 18, and attach to the vertical frame 3.

In order to transport the present invention, the user simply grabs the handle 4 from the side of the pair of primary wheels 7 and tilts the rolling hand truck 1 towards themselves. This action positions the full weight of the present invention on the pair of primary wheels 7, thus allowing the user to push and transport the present invention, similar to traditional dolly trucks. The present invention may further utilize additional features for stability purposes. In particular, the rolling hand truck 1 further comprises a pair of secondary wheels. The pair of secondary wheels provide additional support to the present invention when transported. Similar to the pair of primary wheels 7, the pair of secondary wheels are coaxially positioned with each other, across the base platform 2. Additionally, the pair secondary wheels are positioned adjacent to the pair of primary wheels 7, opposite to the base platform 2 with a secondary axis o the pair of secondary wheels being positioned parallel and offset to the primary axis 8. Furthermore, the pair of secondary wheels is mounted to the vertical frame 3. Each of the pair of secondary wheels is a wheel with a diameter smaller than each of the pair of the primary wheels. When the present invention is tipped to the side for transport, this presses the pair of secondary wheels on the ground and provides four points of contact between the present invention and the ground, thus ensuring additional stability for the present invention during transport and preventing the present invention from accidentally tipping fully over backwards.

Referring to FIG. 1, in order to hide and protect the internal components of the present invention, the rolling hand truck 1 further comprises a first curtain 6, a second U-shaped frame 9, and a second curtain 10. The first curtain 6 is a piece of fabric designed to cover the fresh-water tank 18, the grey-water tank 19, and any components extending underneath the sink body 15. The preferred length of the first curtain 6 is the distance between the base platform 2 and the sink assembly 11. The first curtain 6 is perimetrically positioned adjacent to the first U-shaped frame 5. Additionally, the first curtain 6 is slidably engaged along the first U-shaped frame 5. This allows the user to enclose the front portion of the present invention and expose the front portion of the present invention for cleaning, refilling, and other similar maintenance purposes. The second U-shaped frame 9 is an elongated rod-like structure that is bent 90 degrees at two spots to yield a U-shape. The second U-shaped frame 9 is positioned adjacent to the vertical frame 3, opposite the first U-shaped frame 5. Mirroring the first U-shaped frame 5, the second U-shaped frame 9 is perpendicularly and laterally connected to the vertical frame 3. The second curtain 10 covers and protects the rear portion of the present invention. In particular, the second curtain 10 covers and protects the water heater 26, the pair of primary wheels 7, the pair of secondary wheels, and any other components in the rear portion of the present invention. The preferred length of the second curtain 10 is the distance between the base platform 2 and the sink assembly 11. Similar to the first curtain 6, the second curtain 10 is perimetrically positioned adjacent to the second U-shaped frame 9 and is slidably engaged along the second U-shaped frame 9. This allows the user to enclose the rear portion of the present invention and expose the rear portion of the present invention for cleaning, refilling, and other similar maintenance purposes.

In one embodiment of the present invention, the water heater 26 is an electric water heater 26. The electric water heater 26 converts electricity into thermal heat in order to heat water. In this embodiment, the water heater 26 is positioned in between the pair of primary wheels 7 and is mounted adjacent to the base platform 2. This is due to the fact that the inlet and outlet of an electric water heater 26 is located at the top of the device. In this embodiment, the water heater 26 is electrically powered by an external device or an outlet.

In another embodiment of the present invention, the water heater 26 is a propane water heater 26. The propane water heater 26 uses gas and an internal fire to heat up water. In this embodiment, the present invention further comprises a propane tank. Additionally, the water heater 26 is mounted adjacent to the sink assembly 11 as the inlets and outlet of a propane heater are located on bottom portion. Furthermore, for a self-contained device, the propane tank is also mounted to the vertical frame 3, in between the pair of primary wheels 7 and is in fluid connection with the water heater 26.

Figure 5:
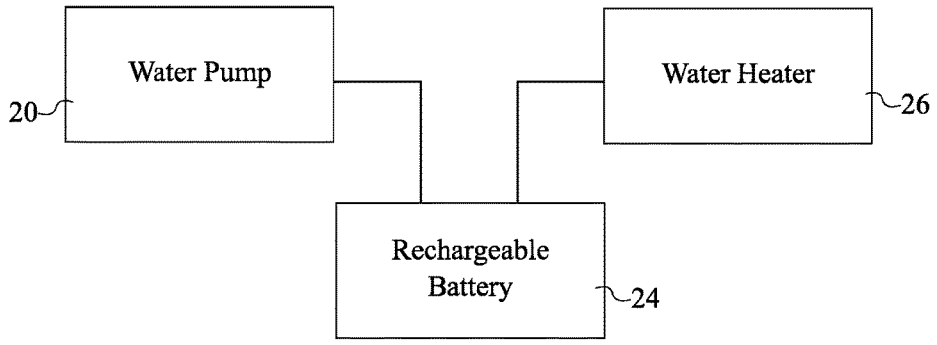
FIG. 5 is an electric schematic of the present invention.

Referring to FIG. 5, the present invention further comprises the rechargeable battery 24. The rechargeable battery 24 powers the water pump 20 and the water heater 26, if an electric water heater 26 is utilized. The rechargeable battery 24 is positioned adjacent to the vertical frame 3, opposite the base platform 2. Additionally, the rechargeable battery 24 is mounted to the vertical frame 3. Furthermore, the rechargeable battery 24 is electrically connected to the water pump 20 and the water heater 26, if an electric water heater 26 is utilized. Alternatively, in another embodiment, the electrical components of the present invention may be powered through an outlet.

Although the invention has been explained in relation to its preferred embodiment, it is to be understood that many other possible modifications and variations can be made without departing from the spirit and scope of the invention as hereinafter claimed.

What is claimed is:

1. A portable self-contained hot water hand-washing station comprises:

a rolling hand truck;

a sink assembly;

a fresh-water tank;

a grey-water tank;

a water heater;

a water pump;

the rolling hand truck comprises a base platform and a vertical frame;

the sink assembly being positioned opposite to the base platform, along the vertical frame;

the sink assembly being perpendicularly mounted to the vertical frame;

the grey-water tank and the fresh-water tank being positioned in between the sink assembly and the base platform;

the grey-water tank and the fresh-water tank being adjacently attached to the rolling hand truck;

the water heater being mounted to the vertical frame, opposite the sink assembly;

the water pump being mounted to the vertical frame, adjacent to the water heater;

the fresh-water tank being in fluid communication with the water pump;

a hot-water outlet of the water pump, the water heater, and a faucet of the sink assembly being in fluid communication with each other;

a cold-water outlet of the water pump being in fluid communication with the faucet;

a drain of the sink assembly being in fluid communication with the grey-water tank;

the rolling hand truck further comprises a second U-shaped frame and a second curtain;

the second U-shaped frame being positioned adjacent to the vertical frame, opposite the first U-shaped frame;

the second U-shaped frame being perpendicularly connected to the vertical frame;

the second curtain being perimetrically positioned adjacent to the second U-shaped frame; and the second curtain being slidably engaged along the second U-shaped frame.

2. The portable self-contained hot water hand-washing station as claimed in claim 1 comprises:

the rolling hand truck further comprises a handle and a first U-shaped frame;

the base platform being terminally and perpendicularly connected to the vertical frame;

the handle being terminally connected to the vertical frame, opposite the base platform;

the first U-shaped frame being positioned in between the handle and the base platform;

the first U-shaped frame being perpendicularly and laterally connected to the vertical frame;

the sink assembly being positioned within the first U-shaped frame; and the sink assembly being perimetrically mounted to the first U-shaped frame.

3. The portable self-contained hot water hand-washing station as claimed in claim 2 comprises:

the rolling hand truck further comprises a first curtain;

the first curtain being perimetrically positioned adjacent to the first U-shaped frame; and the first curtain being slidably engaged along the first U-shaped frame.

4. The portable self-contained hot water hand-washing station as claimed in claim 1 comprises:

the rolling hand truck further comprises a pair of primary wheels, the pair of primary wheels being coaxially positioned with each other, across the base platform;

a primary axis of the pair of primary wheels being positioned offset to the vertical frame; and each of the pair of primary wheels being rotatably mounted to the vertical frame, adjacent to the base platform.

5. The portable self-contained hot water hand-washing station as claimed in claim 1 comprises:

a paper towel holder;

the paper towel holder being positioned parallel and offset to the vertical frame;

the paper towel holder being positioned adjacent to the sink assembly; and the paper towel holder being laterally connected to the vertical frame.

6. The portable self-contained hot water hand-washing station as claimed in claim 1 comprises:

a rechargeable battery;

the rechargeable battery being positioned adjacent to the vertical frame, opposite to the base platform;

the rechargeable battery being mounted to the vertical frame; and the rechargeable battery being electrically connected to the water pump and the water heater.

7. The portable self-contained hot water hand-washing station as claimed in claim 1 comprises:

the sink assembly further comprises a sink body, a faucet, and a mounting lip;

the faucet comprises a hot-water inlet and a cold-water inlet;

the mounting lip being laterally connected about the sink body;

the sink body being positioned within the first U-shaped frame;

the mounting lip being pressed against the first U-shaped frame;

the faucet being integrated into the mounting lip, adjacent to the vertical frame;

the hot-water inlet and the cold-water inlet each being oriented towards the base platform;

the water heater being in fluid communication with the hot-water inlet; and the cold-water outlet of the water pump being in fluid communication with the cold-water inlet.

8. The portable self-contained hot water hand-washing station as claimed in claim 1 comprises:

the sink assembly further comprises a soap dispenser;

the soap dispenser being positioned adjacent to the faucet; and the soap dispenser being perpendicularly integrated into the mounting lip.

9. The portable self-contained hot water hand-washing station as claimed in claim 1 comprises:

an at least one adjustable strap;

the grey-water tank being positioned adjacent to the base platform;

the fresh-water tank being positioned adjacent to the grey-water tank, opposite the base platform; and the grey-water tank and the fresh-water tank being attached to the rolling hand truck by adjustable strap.

* * * * *